United States Patent [19]

Graves

[11] 4,188,876

[45] Feb. 19, 1980

[54] JUNK METAL COMPRESSOR

[76] Inventor: Donald J. Graves, Rte. 1, Spencerville, Ind. 46788

[21] Appl. No.: 862,447

[22] Filed: Dec. 20, 1977

Related U.S. Application Data

[63] Continuation-in-part of Ser. No. 649,051, Jan. 14, 1976, abandoned.

[51] Int. Cl.[2] ..... B30B 9/32

[52] U.S. Cl. ..... 100/232; 100/DIG. 1; 100/233; 100/269 R

[58] Field of Search ..... 100/35, 42, DIG. 1, 100/232, 233, 208, 209, 269 R

[56] References Cited

U.S. PATENT DOCUMENTS

| | | | |
|---|---|---|---|
| 2,932,244 | 4/1960 | Moyer | 100/DIG. 1 |
| 2,932,247 | 4/1960 | Thompson | 100/DIG. 1 |
| 3,101,045 | 8/1963 | Van Endert | 100/DIG. 1 |
| 3,356,018 | 12/1967 | Swint | 100/DIG. 1 |
| 3,545,369 | 12/1970 | Tokushima | 100/DIG. 1 |
| 3,554,119 | 1/1971 | Schoellhorn | 100/233 X |
| 3,796,151 | 3/1974 | Williams | 100/DIG. 1 |
| 3,844,209 | 10/1974 | Allbritton | 100/DIG. 1 |

*Primary Examiner*—Billy J. Wilhite
*Attorney, Agent, or Firm*—Gust, Irish, Jeffers & Hoffman

[57] ABSTRACT

Method and apparatus for compressing or compacting junk vehicle bodies and the like is disclosed wherein a crushing machine has a frame with a generally horizontally disposed bed and a plurality of upright supports extending from the bed to at least one generally horizontal beam which connects the ends of the upright supports remote from the bed to form a generally rectangular framework with a longitudinal vehicle accepting aperture therethrough. A pair of arms are hinged to the frame at opposite sides of the opening and pivot between generally vertical and generally horizontal positions with a portion of one arm overlapping a portion of the other. The arms are actuated by hydraulic cylinders and are independently movable so that they may be overlapped in either order when in their horizontal positions. The vehicle body is compacted into a relatively flat unitary mass by the arms engaging opposed portions of vehicle side walls near the upper ends thereof and forcing the engaged portions initially, primarily toward one another and subsequently primarily downwardly to flatten a portion of the vehicle body. The body may then be moved and a new portion similarly compacted so that the vehicle body is ultimately folded in and downwardly toward the vehicle frame. A modification for compacting smaller salvageable materials is also disclosed.

5 Claims, 7 Drawing Figures

JUNK METAL COMPRESSOR

CROSS REFERENCE TO RELATED APPLICATIONS

The present application is a continuation-in-part of my copending application Ser. No. 649,051, filed Jan. 14, 1976, now abandoned.

BACKGROUND OF THE INVENTION

The present invention relates generally to crushing machinery and more particularly to a system for compacting a junk vehicle body into a relatively flat unitary mass for shipping and subsequent processing to recover scrap metal.

Discarded automobiles and the like are to say the least, unsightly if merely left to rust in a junkyard, and further represent a resource in their scrap metal content, which should be utilized. Many large scale auto salvage operations have expensive installations for melting down or otherwise processing such scrap metal, while other auto salvage operations may have large and expensive crushing machines for compacting a discarded vehicle body into a relatively flat mass so that numerous such compacted bodies may be stacked on a truck for shipment to a location where melting or recycling equipment is available.

Vehicle body compacting equipment is extremely large, sophisticated and expensive and in general, out of the reach of many smaller auto salvage companies. The known vehicle crushers are of a size to require an entire large tractor trailer for moving them from location to location or even larger, necessitating a fixed location installation. The prior art does not provide a small, inexpensive, relatively easily movable crushing machine.

SUMMARY OF THE INVENTION

Among the several objects of the present invention may be noted the provision of: a relatively small lightweight, inexpensive, portable structure capable of crushing junk vehicle bodies;

the provision of a method of compacting a vehicle body requiring less equipment than in the prior art processes;

the provision of a system for compacting a vehicle body wherein the side walls of that vehicle are first urged inwardly near their upper ends and then downwardly toward the vehicle frame to provide a compact relatively flat unitary mass for shipping; and the provision of a vehicle crushing system employing a pair of hinged crushing arms hydraulically operated and overlapped so that the force applied to one may aid the other in providing a more compact mass for a given size machine.

In general and in one form of the invention apparatus for compacting vehicle bodies and the like accomplishes the steps of engaging opposed portions of those vehicle side walls near upper ends thereof and forcing the engaged portions initially primarily inward toward one another and subsequently, primarily downwardly to flatten a portion of the vehicle body. The vehicle body may be moved within the equipment and the steps repeated as many times as is necessary to completely crush the body.

Further, in general and in one form of the invention, a frame is formed of a horizontally disposed bed with upright supports and one or more beams connecting the ends of the upright supports remote from the bed to form a generally rectangular framework with a vehicle accepting opening therethrough. A pair of fluid actuated arms are hinged to the frame and are movable between generally vertical positions toward one another and into generally horizontal positions for crushing the vehicle. The arms may be vertically superimposable or overlapped in either order so that the force applied to one of the arms will aid the other in compressing the vehicle body.

BRIEF DESCRIPTION OF THE DRAWINGS

The subject matter which I regard as my invention, is particularly pointed out and distinctly claimed in the concluding portion of the specification. The invention itself, however, together with further objects and advantages thereof may be better understood by reference to the following description taken in conjunction with the accompanying drawings in which like reference numerals identify like components and in which:

DESCRIPTION OF THE PREFERRED EMBODIMENT

Figure 1:
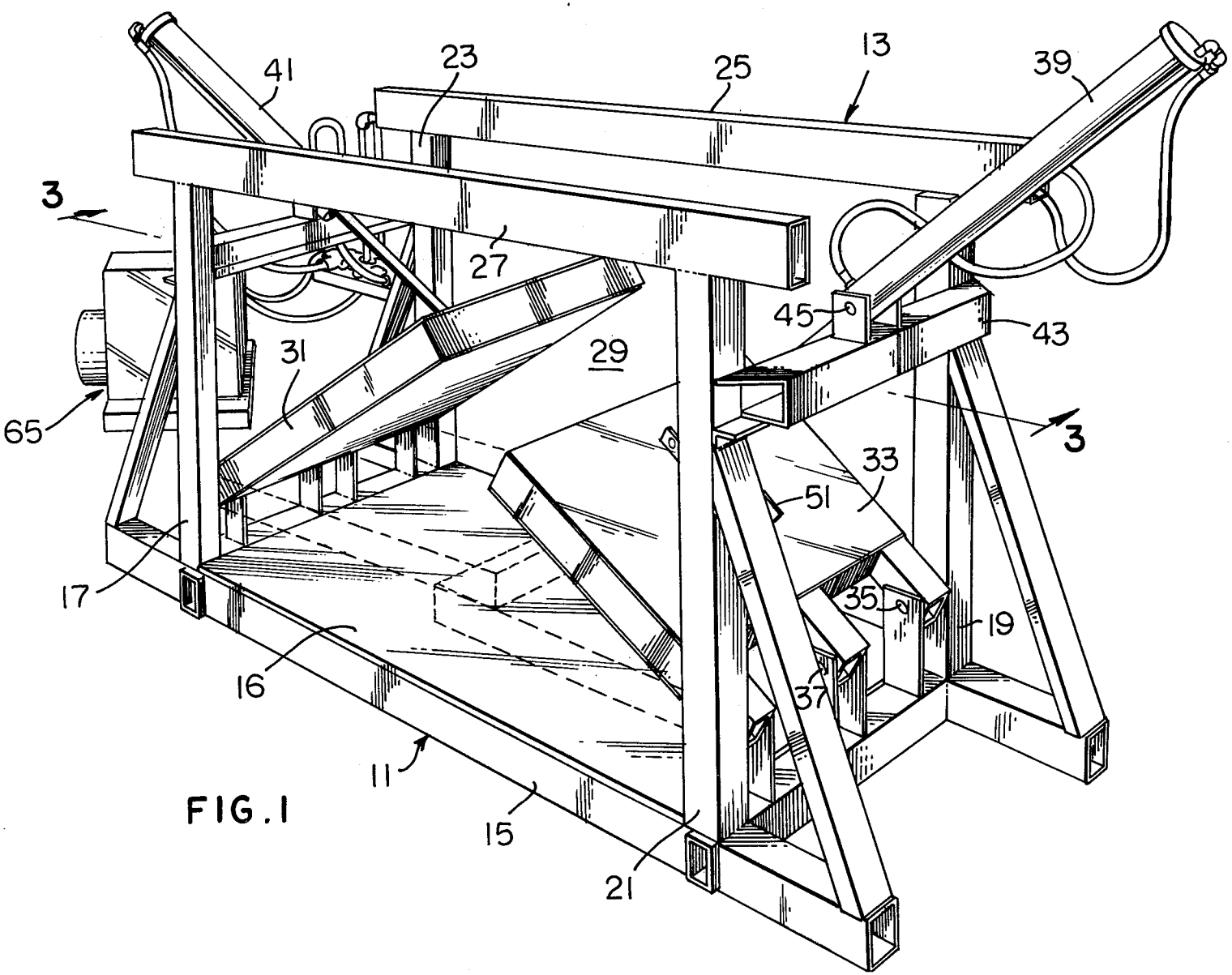
FIG. 1 is a perspective view of a crushing machine according to the present invention.

Referring primarily to FIG. 1 of the drawing, the crushing machine 11 has a frame 13 including a bed or base 15 which provides a generally flat horizontal surface on which a vehicle to be crushed is placed. Upstanding from the bed are a plurality of upright supports 17, 19, 21 and 23 and the ends of these upright supports remote from the bed are connected together by horizontally disposed beams 25 and 27. The frame therefore forms a generally rectangular framework with a longitudinal vehicle accepting opening 29 therethrough.

Figure 3:
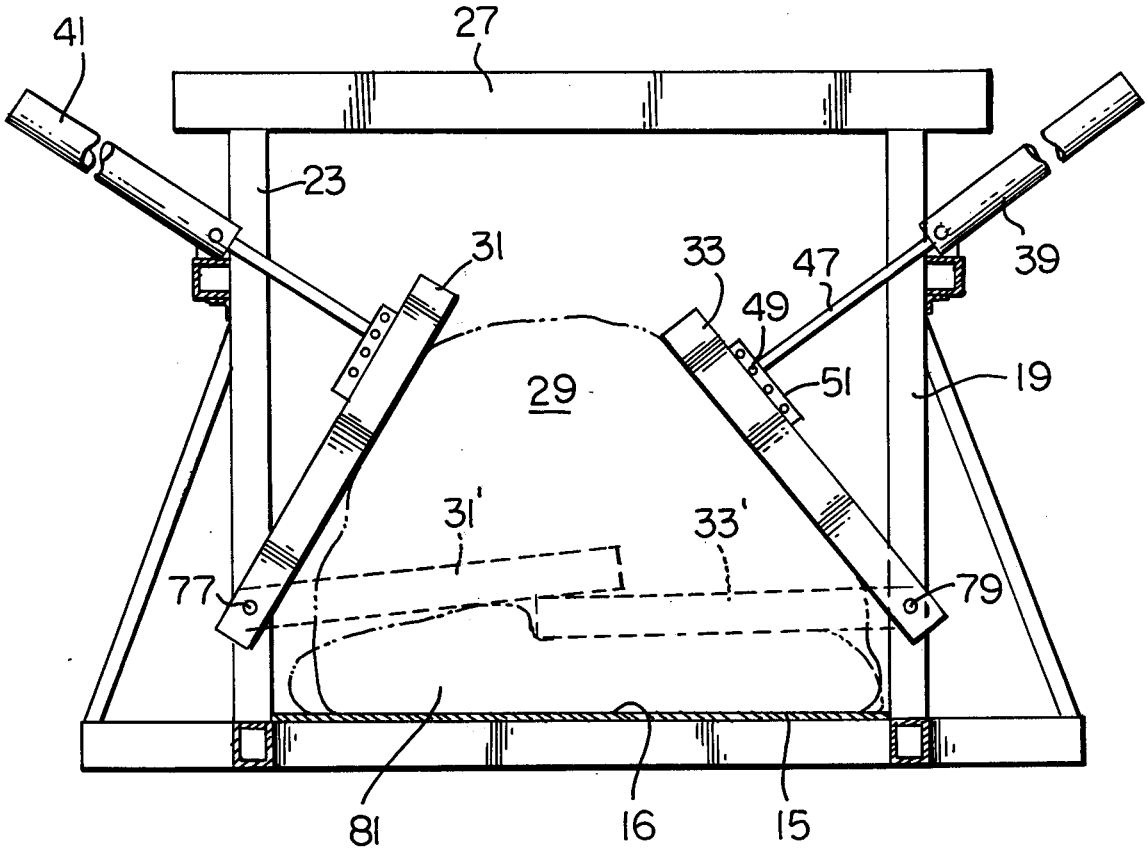
FIG. 3 is a front view of a portion of the crushing machine of FIG. 1 illustrating the action thereof on a vehicle body.

A pair of arms 31 and 33 are hinged to the frame and pivotable about pins such as 35 and 37. These pivotable arms or hinged flaps are pivotable between generally vertical positions close to their corresponding upright supports and generally horizontal positions, as best seen in FIG. 3 where a portion of the arm 31 is vertically superimposed over a portion of the other arm 33. A fluid actuated device such as the bidirectional (reversible) hydraulic cylinders 39 and 41 move the arms about their respective pivots. The housing of cylinder 39 is pivotally attached to a cross member 43 of the frame by a pin 45 and the piston rod 47 is similarly pivotally attached to the arm 33 so that the hydraulic cylinder may tilt appropriately during the pivoting of the arm. FIG. 3 illustrates the manner of attachment of the piston rod 47 to the arm or flap 33 in greater detail wherein a pivot pin 49 passes through one of several apertures in a bracket which is attached to the arm 33 and through the piston rod. The pin 49 may be removed from the bracket 51 and the piston rod 47 moved to align with a different hole and the pin 49 be reinserted to thereby change both the leverage which the cylinder 39 can exert on the arm 33 and to change the distance traveled by the arm 33 for a given piston rod travel.

Figure 2:
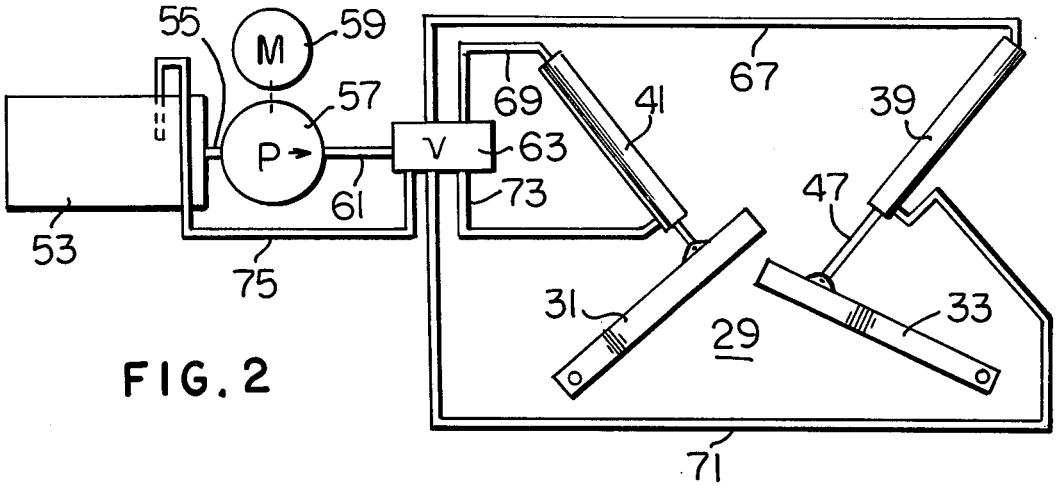
FIG. 2 is a front partially schematic view of the crushing machine of FIG. 1.

The manner in which the hydraulic cylinders 39 and 41 are actuated is best seen in FIG. 2 where a tank or reservoir 53 of a fluid such as oil is supplied by way of conduit 55 to a pump 57 driven by a motor 59. The output of the pump 57, which may, for example, be a Vickers vane type single pump, passes through conduit 61 and into valve 63. This valve is of a commercially available type such as a pair of independently actuable Deltrol single spool directional control valves and may be mounted at any convenient location on either the frame 13 or the hydraulic supply system 65 of FIG. 1. The valve, by proper control manipulation, may supply the fluid under pressure to any of the four conduits 67, 69, 71 and 73. Thus, for example, to move both arms simultaneously toward one another and downwardly, fluid under pressure is supplied to conduit 67 and 69 while conduits 71 and 73 act as drains or return lines for fluid from the cylinders by way of conduit 75 to the reservoir. To retract the arms, fluid under pressure is supplied by way of lines 71 and 73 while lines 67 and 69 function as return fluid drain lines by way of line 75 to the reservoir. If, for example, the fluid flow through line 69 is started somewhat behind the flow through line 67, arm 31 will lag arm 33 in their downward travel, as depicted in FIG. 2. Of course, having supplied cylinder 39 ahead of cylinder 41 would yield the vertical superimposition illustrated in FIG. 3.

A crusher for a standard size American automobile has been constructed and illustratively had an 8 to 9 inch overlap of the arms 31 and 33 with the pivot pins 77 and 79 of FIG. 3 being separated by about 86 inches and lying about 9 inches above the top of the base 15. The length of the crushing machine in the direction of the opening was less than the length of the automobile body and the machine was typically cycled four times with the vehicle being moved between each cycle to crush a new portion of the body.

The process or method of compacting a vehicle body should be relatively clear from the foregoing discussion. Initially, the crushing machine has the arms 31 and 32 completely retracted to generally vertical positions and the automobile body is passed into the opening 29 with one end of the vehicle approximately flush with one edge of the machine and with perhaps part of the vehicle extending from the other end of the machine. The machine may, of course, be made sufficiently long to crush the vehicle body in a single stroke or may be, as illustrated, shorter than the vehicle requiring several, such as four, cycles to completely crush the body. The number of cycles and the corresponding machine length depend purely on economic conditions, since the longer crusher requires considerably more in materials, as well as requiring greater force to crush the whole body at one time, thus constituting a more expensive machine, while a shorter crushing machine, of course, requires more time to complete its work. Commensurate with the objective of an economical crusher, the present preferred embodiment requires four cycles to crush a standard American size automobile. With the vehicle body in place, one arm such as 33, as illustrated in FIG. 3, is started ahead of the other and both arms then engage opposed portions of the vehicle side walls near the upper ends thereof and force the engaged portions initially, primarily toward one another, for example, in the position of the arms illustrated as 31 and 33 in FIG. 3, and subsequently these forces become more downwardly to flatten the portion of the vehicle as the positions illustrated at 31' and 33' in FIG. 3. The vehicle body portion which has been crushed then takes on generally the appearance illustrated at 81 in FIG. 3. In this position the compressive or crushing forces of the arm 33 are aided, due to the overlp and downward force provided by arm 31. If it is desired, to more completely crush the body 81, the arms may be retracted and arm 31 started ahead of arm 33 to repeat the process and push downwardly on the left portion of body 81 so that the entire body is more completely flattened. The arms are then again retracted and the vehicle moved to a new position for a repeat of this sequence of events. When the vehicle body is completely compacted, it is transferred to a waiting pile or may be loaded on a truck for shipment to a centralized scrap metal processing facility.

FIGS. 4 through 7 illustrate two alternative ways to modify the machine described with respect to FIGS. 1 through 3 to more effectively compact smaller items. In general, the lower opposed ends of opening 29 have been closed by placing thereacross plates such as 83. A further hydraulic cylinder 85 or as an alternative a pair of hydraulic cylinders 87 and 89 have been provided to move a further arm 91 or in the alternative 93 laterally after arms 32 and 34 have moved down to the position illustrated in FIG. 4. Thus, actuation of the additional cylinder or cylinders of FIGS. 4 through 7 will further laterally compact the materials within the crusher.

Figure 4:
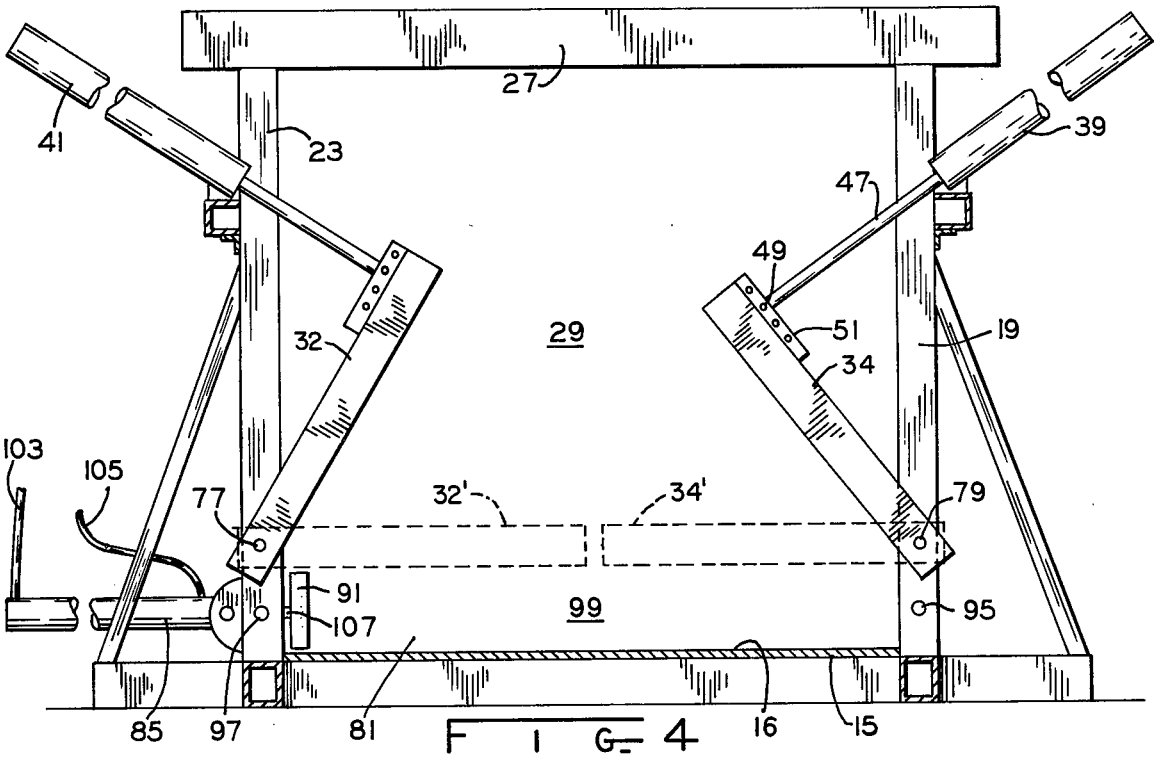
FIG. 4 is a view along line 3—3 of FIG. 1 and analogous to FIG. 3 but illustrating a modification for compacting miscellaneous smaller items.

Referring now specifically to FIG. 4, the modification therein illustrated differs from FIG. 3 only in that the arms 32 and 34 are slightly shorter and do not rely on the overlapping feature discussed earlier, but rather may assume the positions illustrated in FIG. 4 as 32' and 34''. Additional apertures 95 and 97 have been provided for attaching a back side plate 99, identical in appearance to the plate 83 illustrated in FIG. 5. Further, a bracket 101 is provided for affixing hydraulic cylinder 85 to move the additional plate 91 laterally to further compress the materials already compacted by the downward movement of arms 32 and 34, with that material being confined within the crushing machine by the opposed end plates 83 and 99. Hydraulic leads, such as 103 and 105, connected by way of additional valving, not illustrated, to the pump 57 of FIG. 2 for respectively extending and retracting piston rod 107 and its associated plate 91 are also illustrated.

Figure 5:
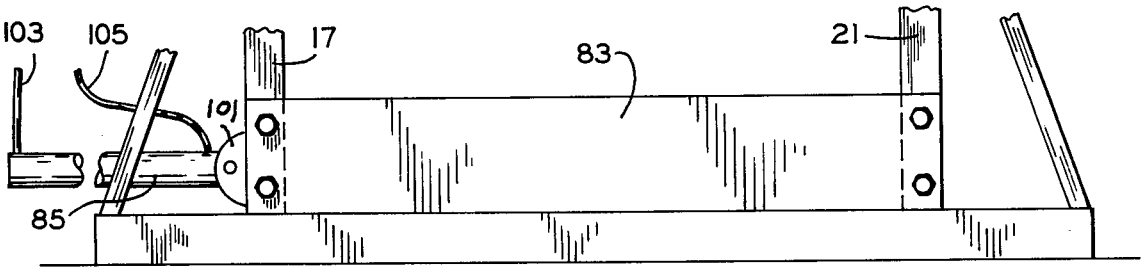
FIG. 5 is a side view from the same direction as FIG. 4 of a portion of the machine modified as illustrated in FIG. 4.
Figure 6:
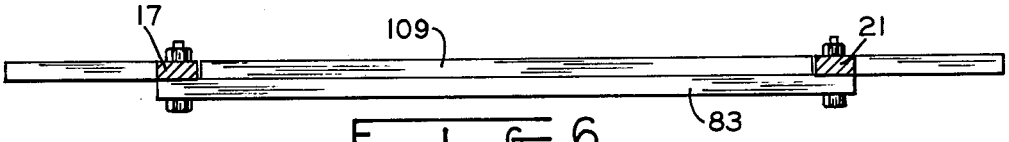
FIG. 6 is a top view of a portion of FIG. 5 illustrating the side plate for compacting smaller materials.

The front view illustrated in FIG. 5 shows the manner of attachment of plate 83 to the upright frame members 17 and 21, with a pair of bolts passing through plate 83, and through the upright members 17 and 21, as better seen in FIG. 6. Inwardly of plate 83 is a further spacer plate 109, which may optionally be welded or bolted to plate 83, which functions to prevent compressed material from squeezing out into the space filled by spacer plate 109, and thereby avoiding the action of the movable compressing plate 91.

Figure 7:
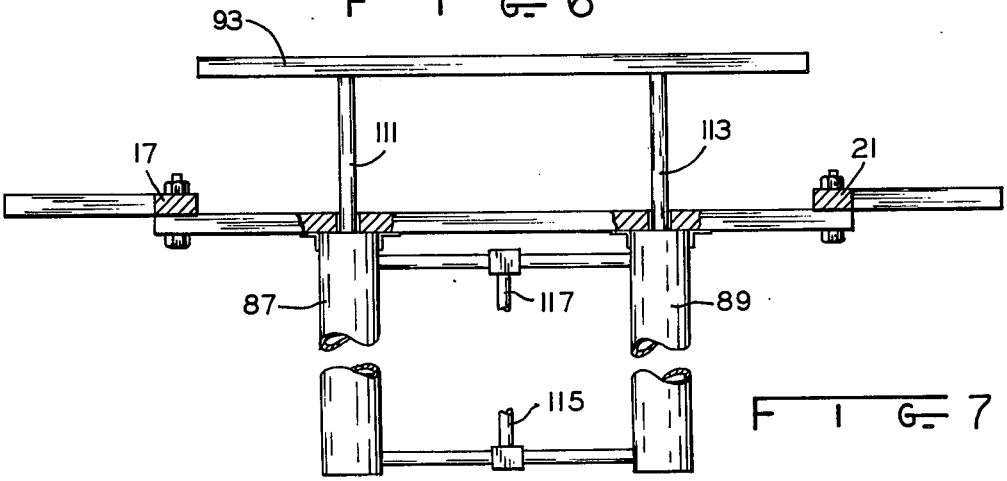
FIG. 7 illustrates a modification to the side plate of FIG. 6 for compacting materials in a direction perpendicular to that accomplished by the structure of FIG. 4.

FIG. 7 illustrates a further modification wherein the cylinder 85 and its associated parts have been deleted and replaced by an arrangement for compacting the already compressed material in a direction perpendicular to that achieved by plate 91. In the arrangement illustrated in FIG. 7, the side plate 83 is provided with a pair of openings through which piston rods 111 and 113, associated respectively with hydraulic cylinders 87 and 89, may move. A common lead for extending the two cylinders simultaneously is illustrated at 115, while a common retracting lead is illustrated at 117, with these two leads of course being coupled through the appropriate valving arrangement to the pump of FIG. 2. Removal of the plates 83 and 99 by merely withdrawing the eight bolts, readies the machine for crushing vehicles, as described earlier.

Ramifications and modifications of the present invention should now be apparent. Vehicles may be crushed intact or parts such as the motor and wheels may be removed prior to crushing. For crushing larger vehicles such as trucks or busses, a larger machine having a larger opening 29 can be used. The machine may be used for compacting other types of salvageable material including household appliances, fence wire or even tin cans. The machine may, of course, be used in conjunction with a winch arrangement for moving the vehicle sequentially therethrough rather than employing the more conventional heavy equipment fork-lift devices commonly encountered in this environment.

Thus while the novel apparatus for compressing scrap material has been fully and completely described by the foregoing specification, numerous modifications will readily suggest themselves to those of ordinary skill in the art and accordingly the scope of the present invention is to be measured only by that of the appended claims.

What is claimed is:

1. A crushing machine for compressing junk vehicle bodies and the like comprising:

a frame having a generally flat, generally horizontally disposed bed for supporting a vehicle body at each of a plurality of sequential body crushing positions, a plurality of upright supports upstanding from the bed, and a pair of generally horizontally disposed beams connecting ends of upright supports remote from the bed, the bed, upright supports and beams connected together to form a generally rectangular framework with a longitudinal vehicle accepting opening therethrough through which a vehicle body may be passed with the rectangular framework completely encircling the vehicle, the length of the crushing machine in the direction of the opening being less than the length of the vehicle body to be compressed and the horizontal width of the opening being close to and somewhat greater than the width of the body of the vehicle to be compressed;

a pair of arms hinged to the frame near the bed and pivotable between generally vertical positions close to respective upright supports toward one another and the bed, and into generally horizontal positions; and fluid actuated means for pivotally moving each of the arms whereby a body may be placed on the bed, fluid supplied to actuate the arms to pivot toward one another and the bed to compress a portion only of the body with the compressing forces being applied to the body initially primarily in a horizontal direction and becoming more vertical as the compressing continues.

2. The crushing machine of claim 1 further including means for laterally compressing materials captured beneath the said pair of arms when those arms are disposed generally in a horizontal plane.

3. The crushing machine of claim 2 wherein the means for laterally compressing includes a pair of removable plates optionally affixed to the rectangular framework for partially closing the longitudinal vehicle accepting opening.

4. The crushing machine of claim 2 wherein the means for laterally compressing includes further fluid actuated means affixed to the frame and having a piston rod extensible for laterally compressing the material.

5. The crushing machine of claim 4 wherein the means for laterally compressing further includes a horizontally movable plate disposed beneath the pair of arms and movable laterally in response to actuation of the further fluid actuated means.

* * * * *